United States Patent [19]

Locker

[11] 4,449,570

[45] May 22, 1984

[54] AIR CIRCULATION APPARATUS

[76] Inventor: Howard W. Locker, 820 N. Ocean Blvd., Delray Beach, Fla. 33444

[21] Appl. No.: 317,075

[22] Filed: Nov. 2, 1981

Related U.S. Application Data

[63] Continuation of Ser. No. 91,095, Nov. 5, 1979, abandoned, which is a continuation-in-part of Ser. No. 17,412, Mar. 5, 1979, abandoned, which is a continuation-in-part of Ser. No. 817,222, Jul. 20, 1977, Pat. No. 4,142,456.

[51] Int. Cl.[3] ..... F24F 7/00

[52] U.S. Cl. ..... 165/65; 98/40 V; 98/94 R; 98/121 R; 165/54; 62/408

[58] Field of Search ..... 165/122, 54, 126, 65; 98/40 D, 94 R, 40 V, 121 R, 94 AC; 415/148; 62/262, 408

[56] References Cited

U.S. PATENT DOCUMENTS

| | | | |
|---|---|---|---|
| 2,000,112 | 5/1935 | Wheller | 165/126 |
| 3,540,525 | 11/1970 | Bradshaw | 165/122 |
| 3,760,708 | 9/1973 | Burup | 98/40 D |

*Primary Examiner*—Albert J. Makay
*Assistant Examiner*—Henry Bennett
*Attorney, Agent, or Firm*—Hauke & Patalidis

[57] ABSTRACT

An air circulation apparatus provided with a plurality of outlet nozzles separating the air flowing from the air circulation apparatus into a plurality of diverging air jet streams. The air circulation apparatus may take the form of a recirculation blower, an air space heater, or a room air conditioner.

5 Claims, 8 Drawing Figures

FIG. 1
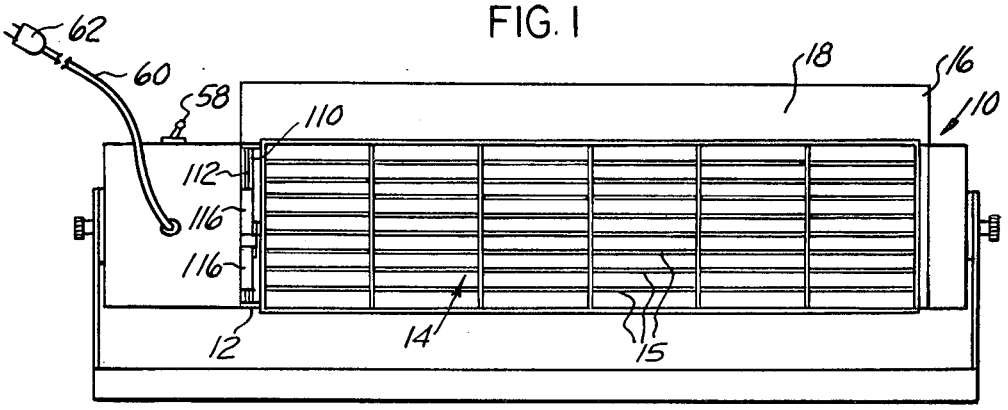
FIG. 2
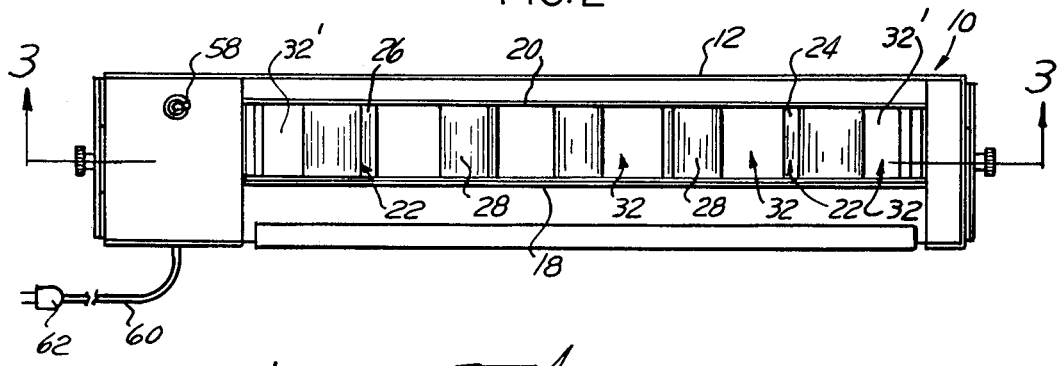
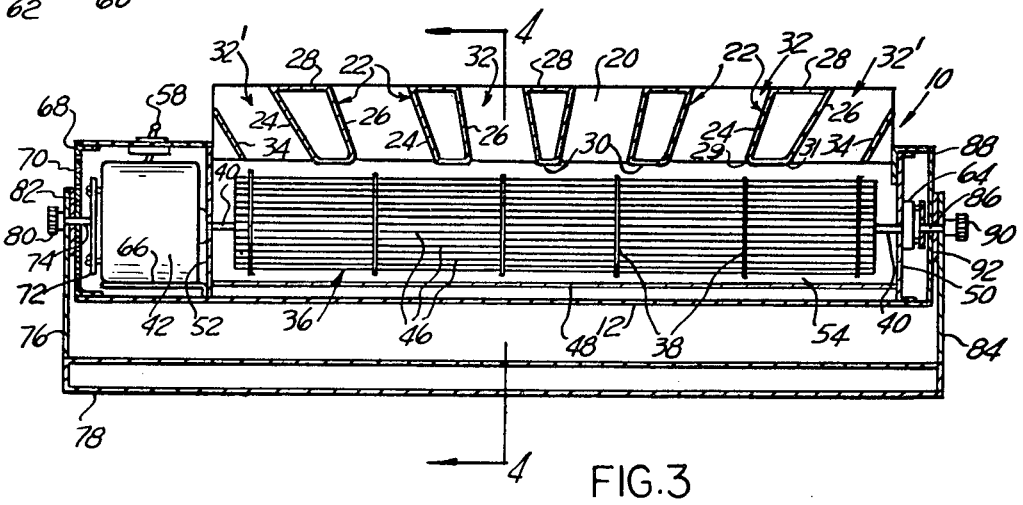
FIG. 3

FIG.6
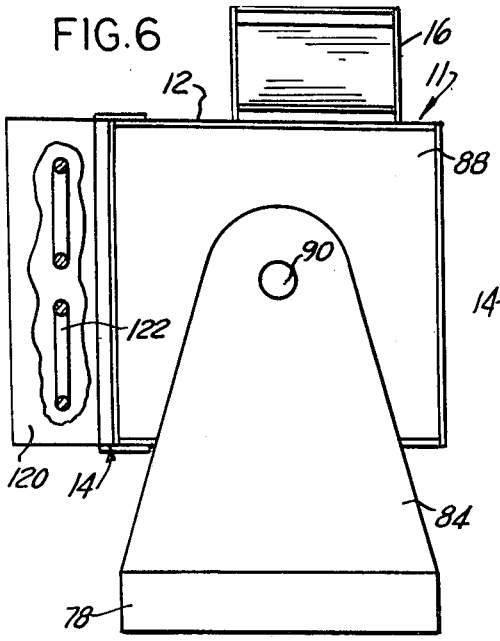
FIG.5
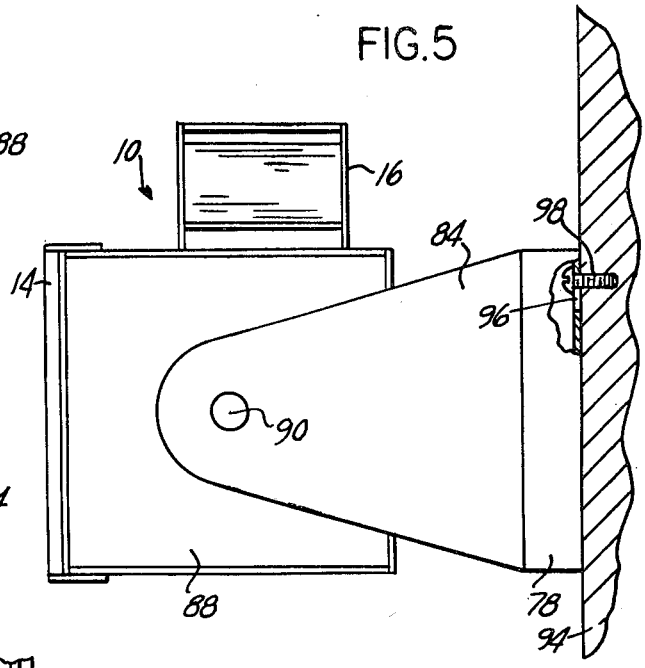
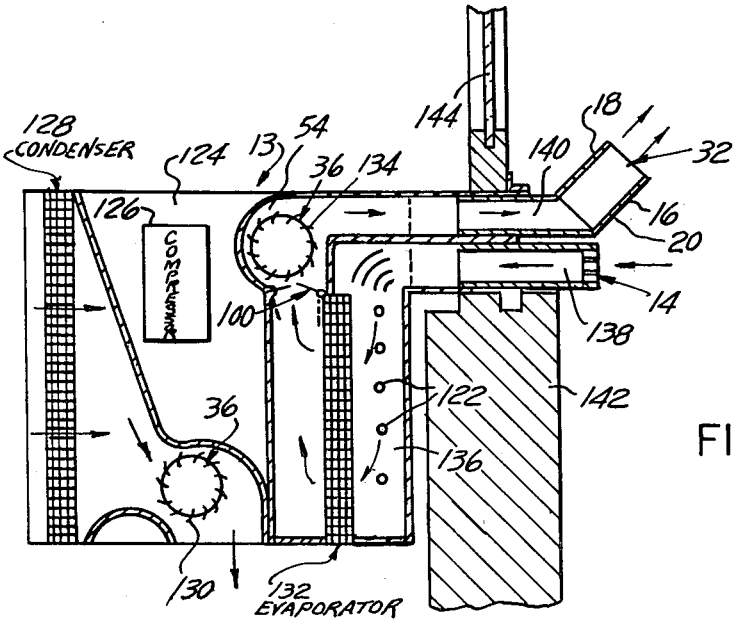
FIG.7
FIG.8
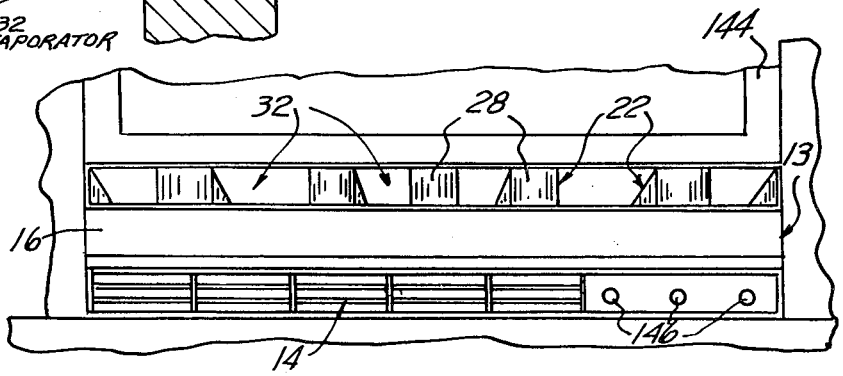

AIR CIRCULATION APPARATUS

CROSS REFERENCE TO RELATED APPLICATIONS

This is a continuation of application Ser. No. 091,095, filed Nov. 5, 1979 now abandoned, which a continuation-in-part of application Ser. No. 17,412, filed Mar. 5, 1979 for Air Diffuser, now abandoned, which is in turn a continuation-in-part of application Ser. No. 817,222, filed July 20, 1977, for Air Diffuser, now U.S. Pat. No. 4,142,456, issued Mar. 6, 1979.

BACKGROUND OF THE INVENTION

In application Ser. No. 17,412 and in U.S. Pat. No. 4,142,456, there are disclosed air diffusers for conditioned air, either heated or cooled air, for ceiling and wall outlets, and for room air conditioners, which are particularly effective in preventing direct flow of air into an enclosed space, in slowing down the flow of air by distributing the conditioned air evenly throughout the space, and in mixing the conditioned air thoroughly with the secondary air, or air already present in the space. Such air diffusers, as a result of being provided with diverging outlet nozzles, separate the air stream into a plurality of separate radial jets which thoroughly mix the secondary air in an enclosure with the air of the jets. The incoming air is separated into the radial jets by way of fixed wedge-shaped fins, defining the separate diverging nozzles, which are substantially square in section, and which are disposed each with its longitudinal axis at at least a 15° angle relative to the longitudinal axis of the next consecutive nozzle.

The present invention results from providing recirculating air blowers with a modified air diffuser according to the aforesaid prior patent and application, thus providing a blower with an effective distribution of the outlet air, without creating drafts or uneven distribution of the oncoming air, and contributing the added advantage of substantially reducing the noise of conventional recirculation blowers, air heaters and room air conditioners.

SUMMARY OF THE INVENTION

The invention accomplishes its objects by providing an air blower, more particularly a tangential flow air blower with an air diffuser in the form of a plurality of diverging nozzles separating the flow of air from the blower to the ambient into a plurality of diverging air streams, the nozzles being separated by fixed wedge-shaped members, preferably truncated to reduce the overall length of the nozzle assembly. The invention has applications to air recirculation blowers as well as to air heaters and room air conditioners. Preferably, the invention contemplates coupling a diverging nozzle assembly with an air blower of the tangential flow type.

The diverse objects and advantages of the present invention will become apparent to those skilled in the art when the following description of the best modes contemplated for practicing the invention is read in conjunction with the accompanying drawing wherein:

BRIEF DESCRIPTION OF THE DRAWING

FIG. 1 is a front elevation view of a recirculating air blower according to the present invention;

FIG. 2 is a top plan view thereof;

FIG. 3 is a section along line 3—3 of FIG. 2;

FIG. 5 is a side elevation view thereof showing the blower mounted on a wall;

FIG. 6 is also a side elevation view thereof but showing a modification of the invention;

FIG. 7 is a schematic section through a further modification of the invention; and FIG. 8 is a front elevation view of the modification of FIG. 7.

DETAILED DESCRIPTION OF THE PREFERRED EMBODIMENTS

Figure 4:
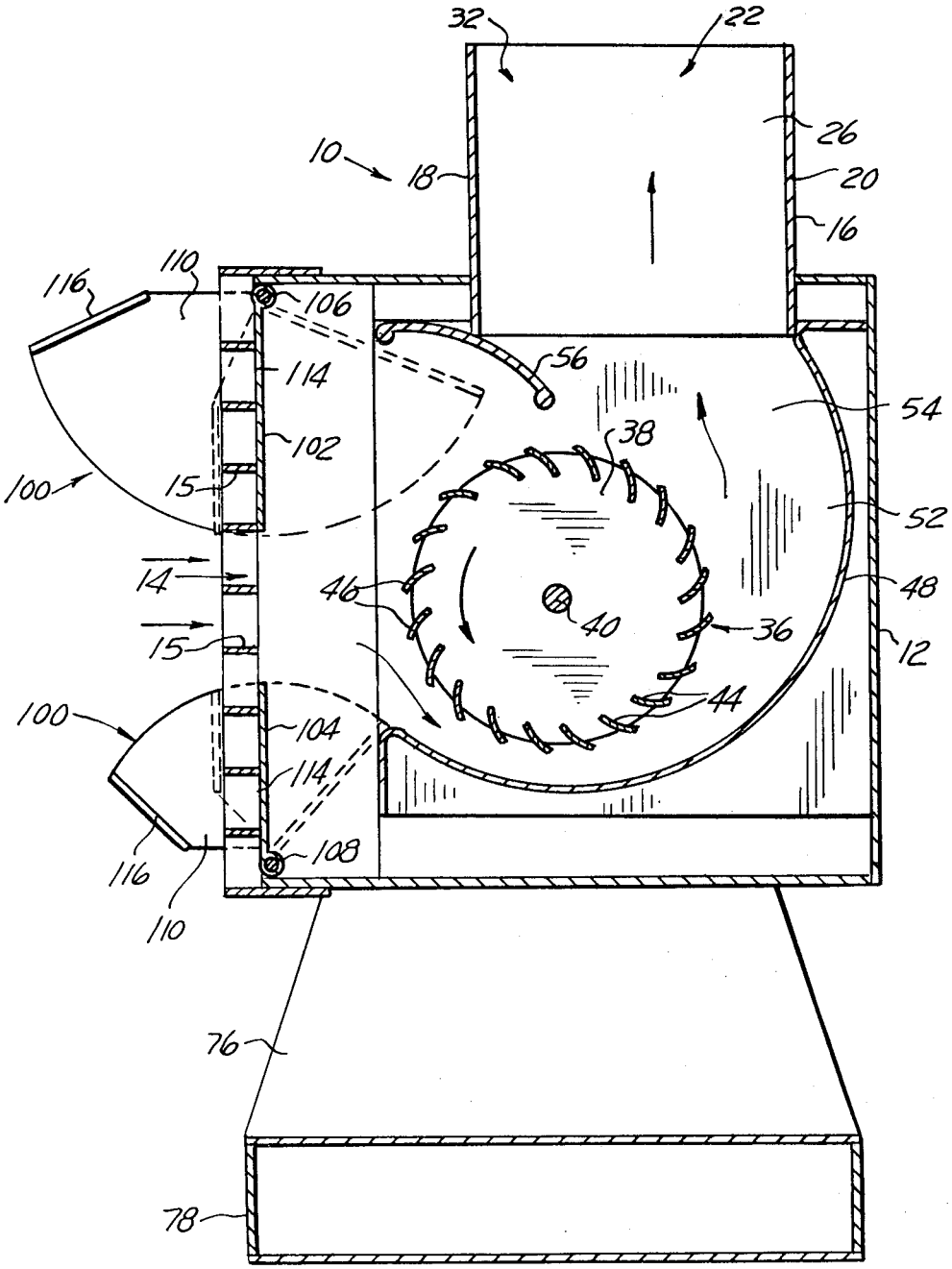
FIG. 4 is a section along line 4—4 of FIG. 3.

Referring now to the drawing and more particularly to FIGS. 1–5, a recirculation air blower 10 incorporating the present invention is in the form of an elongated parallelepipedonal enclosure 12 made of any appropriate convenient material, such as sheet metal or preferably an impact-resistant plastic, having on one side an inlet vent 14, provided with slats 15, and on the top an outlet duct 16. The outlet duct 16 comprises a pair of substantially parallel sidewalls 18 and 20 between which are disposed a plurality, five in number in the structure illustrated of wedge-shaped fin members 22. Each wedge-shaped fin member 22 has a pair of opposite sidewalls 24 and 26, best shown at FIG. 3, which are disposed at a relative angle of at least about 15°, and a flat exterior end wall 28. The inner tip, or leading edge, of each wedge member 22 may be left sharp as a knife edge, as disclosed in the aforesaid patent and patent application, for the purpose of preventing turbulent air current flow or eddies, or they may be provided with a flat wall 30 provided, for the same purpose, with rounded or radiused corners 29 and 31. Between each pair of truncated wedge fin member 22, and between the sidewalls 18 and 20 of the outlet duct 16, there is thus formed a row of diverging nozzles 32, each nozzle being substantially square in cross-section and disposed between the parallel sidewalls 18 and 20 of the outlet duct 16 and between opposite sides 24 and 26 of consecutive wedge-shaped fin members 22. The opposite sidewalls 24 and 26 of consecutive wedge-shaped fin members 22 which form each nozzle 32 are disposed substantially parallel one to the other. Consequently, the diverse nozzles 32 have their longitudinal axes diverging at an angle of at least about 15°.

The lateral nozzles 32' are formed between one lateral wall 24 or 26 of an extreme wedge-shaped fin member 22 and a flat sidewall 34 disposed substantially parallel to the wedge-shaped fin member lateral wall, such that the lateral nozzles 32' are also substantially square in cross-section, and the angle of divergence of the longitudinal axis of each end nozzles 32' is also substantially at least about 15° relative the longitudinal axis of the adjoining nozzle 32.

In the interior of the housing 12 there is, longitudinally disposed, a tangential flow blower impeller 36, FIGS. 3 and 4, comprising a plurality of parallel disk members 38 mounted on a common shaft 40 driven by an electric motor 42. The disks 38 are appropriately slotted at their edge as shown at 44, FIG. 4, and support a plurality of impeller blades 46. The tangential flow blower impeller 36 is partly surrounded by a shroud 48 directing the flow of air, when the impeller is driven at a high velocity in rotation by the motor 42, from the grilled inlet vent 14 to the outlet duct 16. The shroud 48, together with a pair of opposite end walls 50 and 52, thus define within the enclosure 12 a "scroll" chamber 54 through which air is caused to circulate from the inlet vent 14 to the outlet duct 16 at relatively high velocity, as a function of the velocity of rotation of the blower impeller 36 as driven by the electric motor 42. A baffle 56 is disposed in the scroll chamber 54 such as to prevent the flow of air set in motion by the rotating blower impeller 36 from being fed back from the outlet to the inlet of the scroll chamber 54.

The electric motor 42 is switched on and off by a switch 58, and electric power is supplied to the motor 42 via a cord 60 having a conventional plug 62 for connection to an electrical outlet.

As best shown at FIG. 3 the impeller shaft 40 is supported at one end by an appropriate bearing 64 mounted on the outside of the scroll chamber end wall 50, and is coupled at its other end directly to the output shaft of the electric motor 42. The housing of the motor 42 is fastened to a mounting plate 66 attached to the bottom of the enclosure 12. The lateral end of the enclosure 12 proximate to the motor 42 is provided with an end wall 68 having a plurality of perforations 70 permitting cooling air to circulate through the cooling vents in the motor housing. The outer lateral end of the motor 42 is provided with a support saddle 72 on which is fastened a stud 74 axially aligned with the impeller shaft 40. The stud 74 passes through an appropriate aperture in the perforated housing end wall 68 and through an appropriate aperture in the lateral support flange 76 of a mounting base 78. The projecting end of the stud 74 is threaded and is provided with a thumb nut 80. A friction washer 82 is disposed between the inner surface of the support flange 76 and the outer surface of the perforated end wall 68.

The support base 78 is provided on its other end with a lateral support flange 84 which supports the other end of the enclosure 12 by means of a stud 86 mounted axially aligned with the impeller shaft 40. The stud 86 has an end fastened to the casing of the bearing 64 and its other end projects through an appropriate aperture in the end wall 88 of the enclosure 12 and through a corresponding aperture in the lateral support flange 84. The projecting end of the stud 86 is provided with a peripheral thread on which is engaged the internal thread of a thumb nut 90. A friction washer 92 is disposed between the outer surface of the end wall 88 of the enclosure 12 and the inner surface of the support flange 84. It can thus be seen that by loosening the thumb nuts 80 and 90, the whole enclosure 12 may be rotated around an axis which is common to the axis of rotation of the blower impeller 36, and which substantially coincides with the axis of the center of gravity of the assembly, such that the outlet duct 16 may be oriented in any appropriate direction when the recirculation blower 10 is, for example, disposed on the floor, resting on its support base 78 or, alternatively, when mounted on a wall 94, FIG. 5. The support base 78 is for that purpose of mounting on a wall, provided on its lower surface with a pair of appropriate mounting slots 96, and a pair of mounting screws 98 being used for attaching the recirculation blower 10 through its base 78 to the wall 94.

The tangential flow blower impeller 36, together with the scroll chamber 54, consisting of the shroud 48, the end walls 50 and 52, and the baffle 56, is available commercially for example from Lau Incorporated, a subdidiary of Philips Industries, Inc., of Dayton, Ohio. The electric motor 42 driving the impeller 36 may consist of a variable speed motor with appropriate controls or, preferably, it is a single speed motor of approximately 1,800 rpm.

Rather than varying the speed of the drive motor for varying the air flow rate through the blower 10, it has been found preferable to use a constant speed motor and throttle the flow of air through the blower by means of a throttling arrangement 100, best shown at FIG. 4. The air throttling arrangement 100 comprises a pair of angularly orientable rectangular throttle plates 102 and 104. The throttle plate 102 is hinged at its upper longitudinal edge, as shown at 106, in the inside of the enclosure 12 behind the inlet vent 14. In the closed position illustrated at FIG. 4, the throttle plate 102 abuts against the inner edges of the slats 15 of the inlet vent 14, thus masking a substantial area of the inlet vent 14. In a similar manner, the throttle plate 104 is hinged, as shown at 108, along its lower longitudinal edge. In its closed position, the throttle plate 104 masks also a substantial area of the inlet vent 14. The throttle plates 102 and 104 are hingedly displaceable from the closed position shown in full line to a full open position, as shown in phantom line at FIG. 4, each by means of a plate 110 passing through a slot 112, FIG. 1, through the enclosure 12 at the edge of the grilled inlet vent 14. Each plate 110 has an edge 114 affixed to the corresponding throttle plate, 102 or 104 respectively, and an other edge provided with a rectangular flange 116 which is finger-graspable. Sufficient friction is provided in the hinges 106 and 108 and between the edges of the slots 112 and the surfaces of the plates 110, or by means of a friction shoe, not shown, engaged with the surfaces of the plates 110, to hold the throttle plates 102 and 104 in any intermediary position such that the flow of air through the blower 10 may be adjusted to any desired value from full flow to about 50% of full flow. Throttling, in this manner, the flow of air through the blower 10 is noise-reducing and permits the blower impeller 36 to operate at all times at a constant speed, thus eliminating the need of a more costly variable speed motor.

It has been found that, in order to provide optimum mixing of the air streams from the nozzles 32 with secondary air and to prevent formation of stratified air jets beyond the nozzle outlets, certain predetermined relative dimensional limits and angular limits of divergences of the nozzles are critical. The nozzles 32 are, as previously mentioned, substantially square in cross-section, have substantially parallel sidewalls, and are disposed with their longitudinal axes diverging at least at an angle of 15° relative to adjacent nozzles. All the nozzles 32 are of the same width and consequently, they have equal cross areas. The length of the shortest nozzle is at least equal to its width. The distance between nozzle outlets, consequently the width of the wedge-shaped fin member exterior wall 28, is at least equal to one-half the width of the nozzle. The radius of curvature of the corners 29 and 31 of the leading edge 30 of the truncated wedge-shaped fin members 22, in structure where the walls 24 and 26 are disposed at 15° or where the nozzles 32 have their longitudinal axes mutually diverging at an angle of 15°, is about one tenth of a nozzle width. Within the range of diverging angles of 15° to 28° the width of the flat portion 30 of the leading edge is proportionally linearly narrowed such that the flat portion 30 of the leading edge of the wedge-shaped fin members 22 becomes eventually a single rounded corner and for diverging angles of slightly less than 28° between the sidewalls 24 and 26 of the wedge-shaped fin members 22, and a sharp edge for diverging angles greater than 28°, therefore at higher than 28° angles of divergence between consecutive nozzles 32. An angle of 30° is the higher practical limit, providing a sharp leading edge.

Although the recirculation air blower 10 according to the present invention is particularly suitable for placing in a room to increase air circulation and ventilation therethrough without draft, it is particularly well adapted to a portable forced air heater 11, as schematically illustrated in side view at FIG. 6. In order to convert the recirculation blower of the invention to a forced air heater 11, the grilled inlet vent structure 14 may be removed and replaced with a short duct supporting appropriate electrical resistance heating elements. Alternatively, as shown at FIG. 6, an appropriate inlet duct 120, in the form of a rectangular enclosure open at both ends is mounted in front of the grilled inlet 14. Within the inlet duct 120 are disposed appropriate electrical resistance heating elements 122, and an appropriate switch, not shown, is mounted proximate the switch controlling the blower drive motor to controllably connect portions or all of the electrical heating elements 122 across the electrical power supply.

The present invention is also particularly well adapted to room air conditioners, in view of the high flow rate achieved through an outlet duct incorporating the nozzle structure of the invention. An example of air conditioning unit 13 is illustrated at FIGS. 7–8, consisting of housing 124, FIG. 7 of any appropriate convenient size normally disposed on the exterior of a building, and enclosing a conventional cooling fluid compressor connected to a conventional condenser 128 and a conventional refrigerant evaporator 132. A fan 130, preferably of the tangential flow blower type 36, circulates air through the condenser 128 to cool the refrigerant fluid after it has been condensed in the compressor 126. The refrigerant fluid from the condenser 128 is introduced into the evaporator 132 through which flows air introduced from the inlet vent 14 and drawn by means of a fan 134, in the form of tangential flow type impeller 36. The air, cooled as a result of passage through the evaporator 132, is caused to flow through an outlet duct 16 provided with nozzles 32 formed between wedge-shaped fin members 22, disposed between parallel sidewalls 18 and 20, as previously explained in detail. The outlet duct 16 is either orientable along a vertical angle or disposed at an appropriate angle directed upwardly. The grilled inlet vent 14 leads to a chamber 136, disposed on one side of the evaporator 132, through a telescopic duct 138, and a telescopic outlet duct 140 is disposed between the scroll chamber 54 surrounding the impeller 36 and the outlet duct 16. in this manner, the length of the inlet and outlet ducts 138 and 140 may be adjusted to accommodate variable thickness of wall or window casement 142. More particularly, the air conditioner 13 provides an arrangement wherein a relatively thin portion of the air conditioner unit projects into a room between the window casement 142 and a sliding vertically opening window 144, for example.

Within the chamber 136 may be disposed electrical resistance heating elements 122, such that by turning off the compressor 126 and turning on the electrical heating elements 122, by means of one of the control 146, FIG. 8, the device may be used as a recirculation heater. By turning off both the compressor 126 and the heating elements 122, and remotely operating conventional by-pass dampers, not shown, the device may be operated as an exhaust blower. A throttle mechanism 100, remotely controlled, may be disposed, if so desired, at the inlet of the scroll chamber 54.

Having thus described the present invention by way of structural examples of particular applications thereof, modification whereof will be apparent to those skilled in the art, what is claimed as new is as follows:

1. A portable elongated air circulation apparatus comprising an elongated parallelepipedonal enclosure having four elongated sides and two opposite end walls, an electrically driven elongated tangential flow impeller circulating air from an inlet disposed in a first elongated side of said enclosure to an outlet disposed in a second elongated side of said enclosure, said first and second sides being consecutive elongated sides of said enclosure, a shroud surrounding partially said elongated tangential flow impeller for directing air circulated through said enclosure by said elongated tangential flow impeller from said inlet to said outlet, a support base having a pair of lateral flanges, means connecting said enclosure end walls and said flanges for adjustably positioning said enclosure relative to said support base around a longitudinal axis of said enclosure for orienting said outlet in an appropriate direction, and throttle means for gradually throttling the flow of air through said inlet, wherein said inlet is in the form of a rectangular box-like duct provided with at least one row of regularly disposed stationary nozzles dividing the flow of air through said outlet into separate diverging air streams, said nozzles have substantially parallel opposite sidewalls, said nozzles are substantially square in section and have longitudinal axes mutually disposed at a constant predetermined angle, said constant angle being in the range of about 15° to about 30°, and said nozzles are formed between two opposite parallel sidewalls of said duct by wedge-shaped rigid and stationary fin members each having a flat outer face of a width equal to at least one-half the width of each of said nozzles and a pair of rearwardly converging sidewalls forming an angle equal to the angle of divergence of said nozzles, wherein said throttle means comprises at least one substantially rectangular plate hinged at a longitudinal edge relative to said enclosure at said inlet, said plate being controllably and progressively hingedly movable from a position masking a substantial area of said inlet to a position substantially unmasking said inlet.

2. The apparatus of claim 1 further comprising electrical heating elements disposed at said inlet in the flow of air through said inlet.

3. The apparatus of claim 1 further comprising air cooling means disposed substantially proximate said inlet.

4. The apparatus of claim 2 further comprising air cooling means disposed substantially proximate said inlet.

5. The apparatus of claim 1 wherein said wedge-shaped fin members have a flat leading edge with rounded corners each of a radius substantially equal to one tenth the width of each of said nozzles for an angle of 15° between the axes of said nozzles proportionally decreasing to a sharp leading edge for an angle of 28° and larger.

* * * * *